US006994081B2

(12) United States Patent
Pedersen et al.

(10) Patent No.: US 6,994,081 B2
(45) Date of Patent: Feb. 7, 2006

(54) APPARATUS FOR ROUGHING THE SURFACES OF CASTED CONCRETE BLOCK

(75) Inventors: Hans Pedersen, Frederikssund (DK); Charles Ciccarello, Brossard (CA)

(73) Assignee: Techo-Bloc Inc., St-Hubert (CA)

( * ) Notice: Subject to any disclaimer, the term of this patent is extended or adjusted under 35 U.S.C. 154(b) by 0 days.

(21) Appl. No.: 10/772,333

(22) Filed: Feb. 6, 2004

(65) Prior Publication Data

US 2005/0172947 A1 Aug. 11, 2005

(51) Int. Cl.
*B28D 7/04* (2006.01)
*B28D 1/32* (2006.01)
*B28D 1/20* (2006.01)

(52) U.S. Cl. ..... 125/35; 125/25; 125/9; 125/1; 125/11.16; 198/726; 198/626.1; 198/604; 425/385

(58) Field of Classification Search ..... 125/35, 125/25, 9, 1, 11.16; 198/726, 626.1, 604
See application file for complete search history.

(56) References Cited

U.S. PATENT DOCUMENTS 1,229,582 A * 6/1917 Butterworth ..... 264/145
1,672,938 A * 6/1928 Hervey ..... 156/89.11
1,877,269 A * 9/1932 Colgren ..... 125/5
3,918,210 A * 11/1975 Mori ..... 451/190
5,979,002 A * 11/1999 Anderson ..... 15/53.2
6,109,906 A * 8/2000 Castonguay et al. ..... 425/343
6,540,501 B1 * 4/2003 Bott ..... 425/385
2002/0158363 A1 * 10/2002 Ciccarello et al. ..... 264/162

FOREIGN PATENT DOCUMENTS

CA 2392934 A1 * 1/2004
DE 41 42 396 A1 6/1993
DE 195 48 932 A1 7/1997

* cited by examiner

*Primary Examiner*—Joseph J. Hail, III
*Assistant Examiner*—Bryan Muller
(74) *Attorney, Agent, or Firm*—Ogilvy Renault LLP; Guy J. Houle

(57) ABSTRACT

A casted concrete block surface-roughing machine having an in-line conveyor displaceable over a stationary horizontal support surface for slidingly supporting a lower surface of concrete blocks displaced thereon by the conveyor. At least two pairs of spaced-apart vertically supported conveyor belts are disposed to engage opposed side faces of the concrete blocks to displace them along the stationary horizontal support surface. One of the pairs of the conveyor belts engages the opposed side faces in a lower surface section thereof to expose an upper surface section thereof to be abraded by respective surface abrading devices. The other of the pairs of conveyor belts engage the opposed side faces in the upper surface section of the concrete block to expose the lower surface section thereof to be abraded by further respective surfaces abrading devices.

12 Claims, 7 Drawing Sheets

APPARATUS FOR ROUGHING THE SURFACES OF CASTED CONCRETE BLOCK

TECHNICAL FIELD

The present invention relates to an apparatus for roughing the surfaces of casted concrete blocks and particularly wherein the machine utilizes an in-line conveyor with at least two pairs of spaced-apart vertically supported conveyor belts which are offset vertically to permit full abrasion of opposed side surfaces thereof.

BACKGROUND ART

Surface abrading machines are known such as are illustrated in German Patents DE19548932 and DE4142396 and which uses chains to impact surfaces of concrete blocks. These abrading devices use a motor driven shaft about which chain links are secured and rotated for impacting a top surface of blocks, which are conveyed thereunder on a conveyor platform. U.S. Pat. No. 6,109,906 discloses a different type of machine and wherein blocks are retained between opposed conveyor belts to each side of a similar abrading device but supported vertically for impacting a surface of each of the blocks conveyed thereby. In all of these devices the blocks need to be reconveyed in order to expose further surfaces as these machines are capable of abrading a single surface only of these blocks. This is an expensive and time-consuming operation. Also, these abrading machines only abrade surfaces of blocks and do not impact on corner areas of the blocks. They were conceived primarily to abrade a surface, which is intended to be exposed to give it the look of an aged stone.

SUMMARY OF INVENTION

According to a broad aspect of the present invention, there is provided a casted concrete block surface-roughing machine having an in-line conveyor displaceable over a stationary horizontal support surface for slidingly supporting a lower surface of concrete blocks displaced thereon by the conveyor. At least two pairs of spaced-apart vertically supported conveyor belts are disposed to engage opposed side faces of the concrete blocks to displace them along these stationary horizontal support surface. One of the pairs of the conveyor belts engages the opposed side faces in a lower surface section of the blocks to expose an upper surface section thereof to be abraded by respective surface abrading devices. The other of the pairs of conveyor belts engage the opposed side faces in the upper section of the concrete block to expose the lower surface section thereof to be abraded by further respective surface abrading devices.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
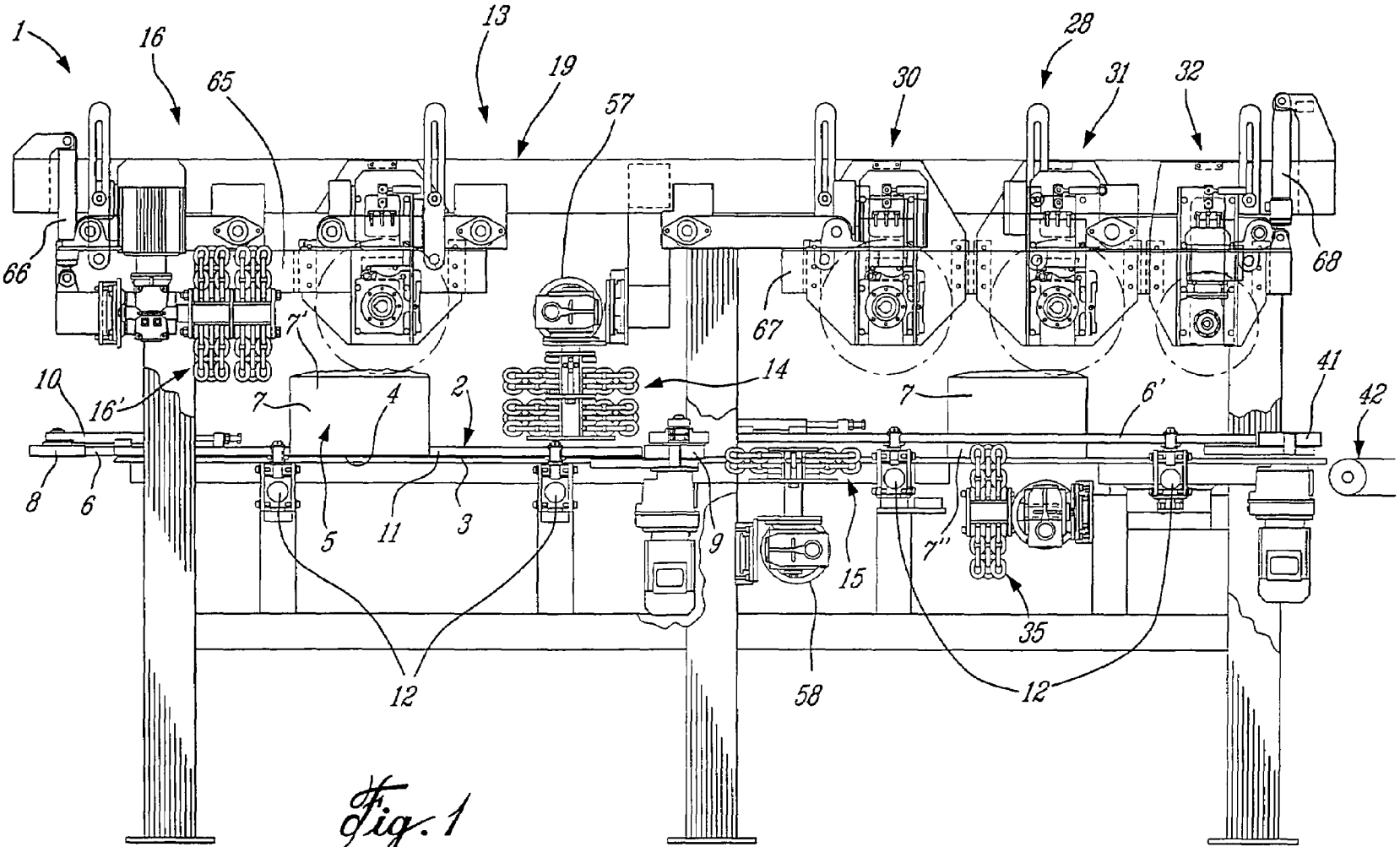
FIG. 1 is a side view of the casted concrete block surface roughing machine with parts thereof having been removed for simplicity of illustration.
Figure 9:
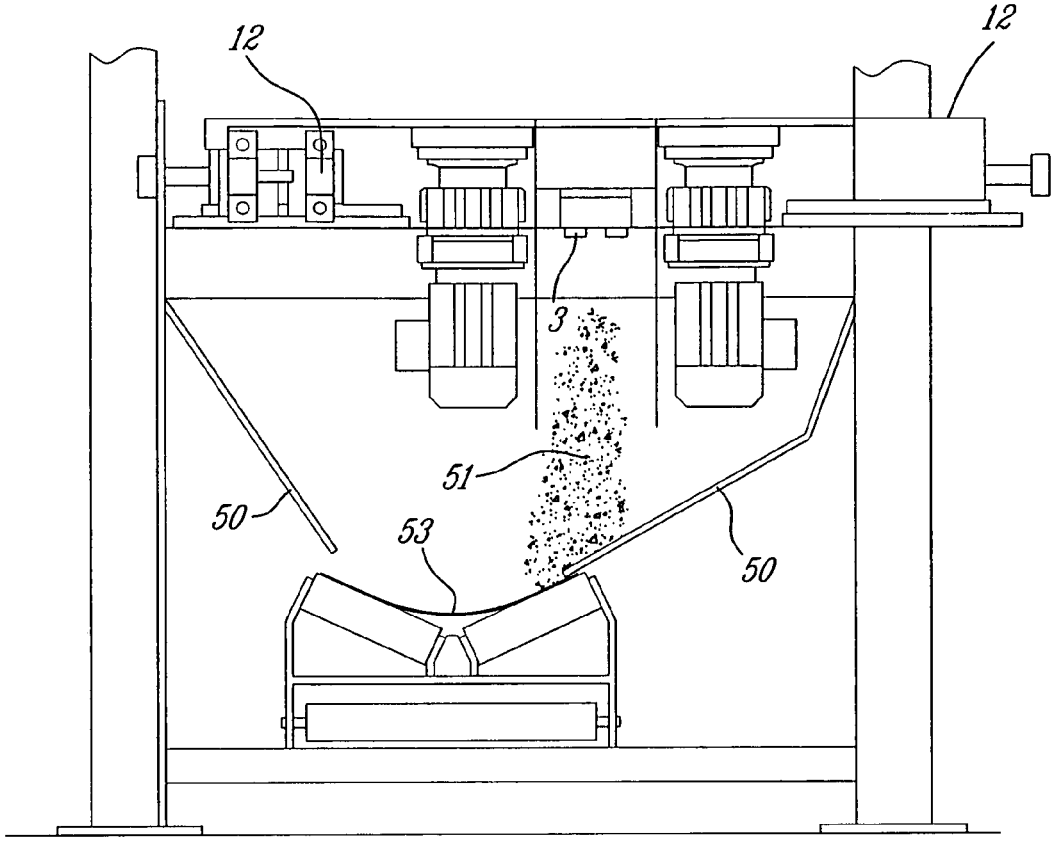
FIG. 9 is an end view of the end section of the surface-roughing machine.

FIG. 1 illustrates the construction of the casted concrete block surface roughing machine 1 constructed in accordance with this invention. This machine comprises an in-line conveyor 2 having a stationary horizontal support surface 3 on which is slidingly displace a lower face 4 of a plurality of casted concrete blocks 5. These blocks 5 are displaced on the stationary support surface 3 by at least two pairs of spaced apart vertically supported conveyor belts 6 which are disposed to engage opposed side faces 7 of the concrete blocks 5 whereby to displace the concrete blocks along the stationary horizontal support surface 3. These pairs of conveyor belts are endless conveyor belts each being trained between a pair of pulleys 8 & 9 with at least one of these pulleys, herein pulley 8 being adjustably displaceable by an adjustable support 10 whereby to tension or to adjust the tension of its associated conveyor belts 6. A straight backing wall 11 is disposed in a straight run of the conveyor belt which is in contact with the concrete casted blocks 5 conveyed thereby. At least one of the straight backing wall, herein wall 11 is adjustably displaceable-in parallel relationship to an opposed wall of the other conveyor belt, not shown but obvious to a person skilled in the art, to receive blocks of different widths between the pairs of conveyor belts. The adjustable straight backing wall 11 is pressure biased against its associated belt straight run by means of a spring loaded link assembly 12 as illustrated in FIG. 9 whereby to apply pressure on the straight run of the conveyor belt against the side face 7 of the concrete casted block 5.

As can be seen from FIG. 1 there is provided two pairs of spaced apart vertically supported conveyor belts namely belt 6 and 6'. These belts are secured at different horizontal elevations from one another for the reason as will be described herein. Both these pairs of spaced apart vertically supported conveyor belts are disposed to engage opposed side faces 7 of the concrete blocks 5 to displace them along a straight path over the stationary horizontal support surface. A pair of belts 6 in the front section 13 engage the opposed side faces 7 of the block in a lower surface section of the block whereby to expose an upper surface section 7' to be abraded by respective abrading devices herein an upper side surface abrading device 14. The other pair of conveyor belts 6' engage the opposed side faces 7 of the concrete blocks whereby to expose the lower surface section 7" of the block to be abraded by further lower section side face abrading devices 15. It was pointed out that the size of the casted concrete blocks 7, as herein shown is exaggerated for purpose of illustration and usually these blocks are of smaller dimension.

Figure 2:
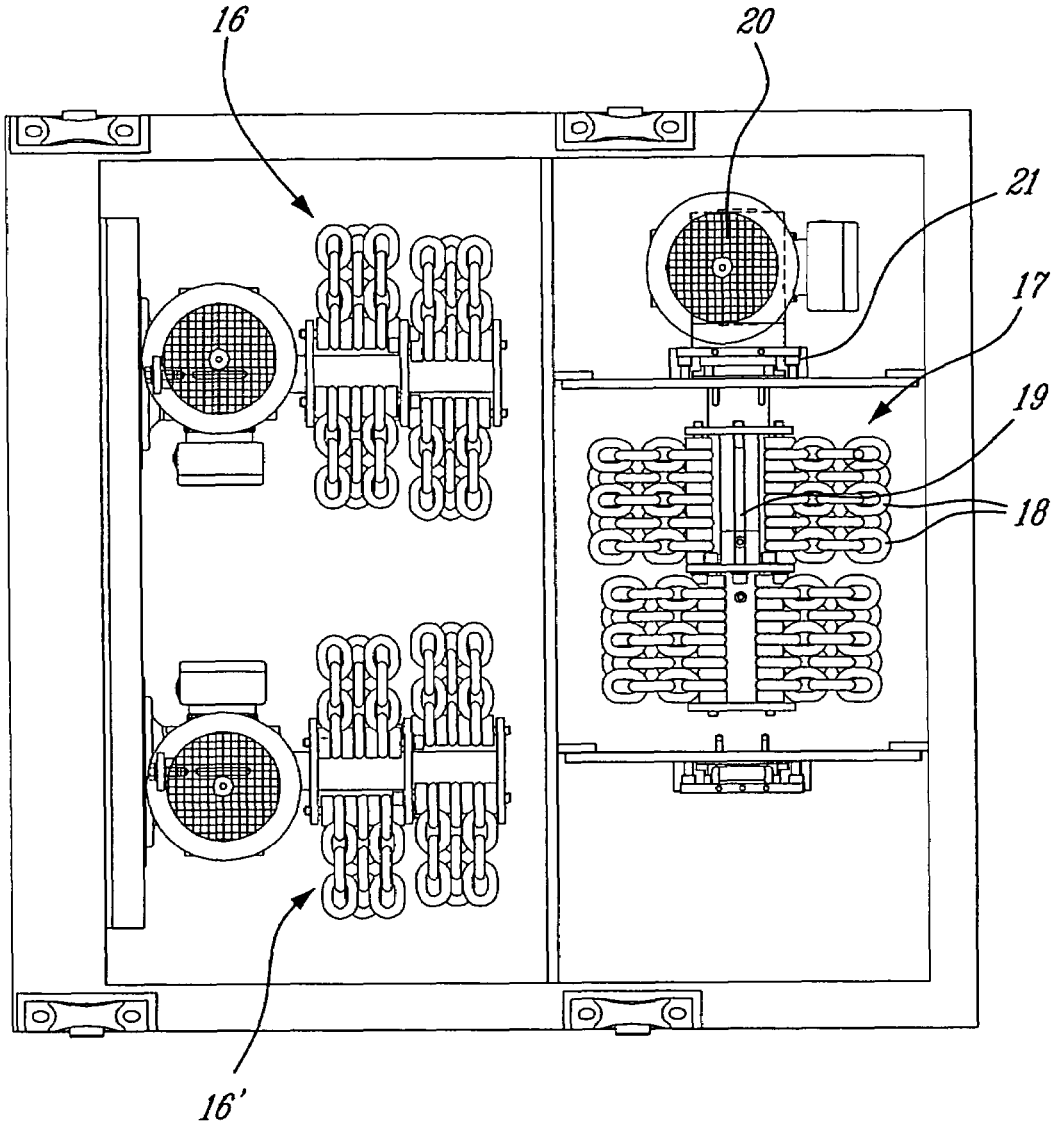
FIG. 2 is a top view of the front section of the surface-roughing machine of FIG. 1.
Figure 3:
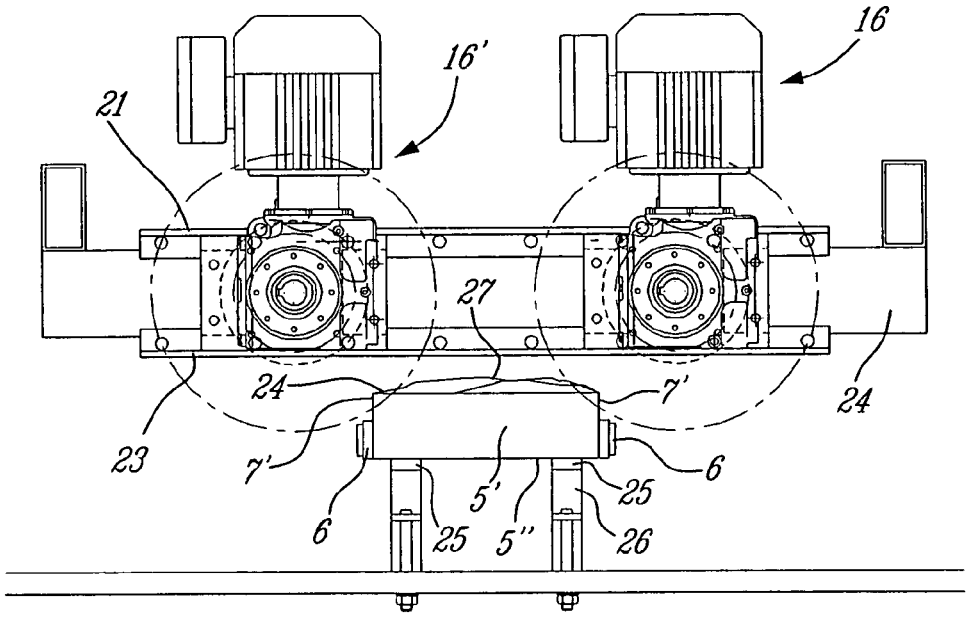
FIG. 3 is an end view showing the top corner abrading devices of FIG. 2 and their adjustability with respect to a casted concrete stone.

As illustrated more clearly in FIG. 2 there is illustrated the first two abrading stations of the front section 13 of the roughing machine and as herein shown, it comprises a pair of top side edge abrading devices 16 and 16' followed a top surface abrading device 17. These abrading devices are comprised essentially by a plurality of chains 18 secured to a motor driven axle assembly 19 and of a motor 20 which is secured to a support frame 21. As shown in FIG. 3 the top side edge of abrading device 16 and 16' have their frame 21 mounted on a carriage 23 which is displaceable on a guide frame 24 whereby to position the chains at predetermined position with respect to the concrete casted blocks whereby to impact a desired region thereof and as herein shown the top corners 24 on opposed sides of the concrete casted blocks 5. As also herein shown the stationary horizontal support surface is constituted by a pair of metal rails 25 having a flat top support surface. Of course a single rail could be provided but it has been found that using two rails which are adjustably mounted on displaceable frames 26, there is provided a better ease of adjustment to support casted stones of different widths.

As shown in FIG. 3, the concrete casted block 5 is provided with flat opposed side surfaces 7' flat end surfaces 5' and a flat bottom surface 5". The top surface 27 is a fragmented surface which is caused by splitting a larger block, casted with all flat surfaces, in half such as to provide a rough surface which is usually the surface to be exposed. However, such surface has jagged edges and it is necessary to smooth out the jagged edges. To do this there is provided the device 19 which is in contact with the top surface. Further, the rear section 28 of the surface roughing machine 1 has additional top surface roughing machines 30 and 31 but these have chain links of smaller size whereby to smooth out the roughened edges. Finally there is provided a smaller surface treating machine 32 which is constructed similar to the other roughing machines but is equipped with a hard bristled brush 33 on its shaft 32' to clean the top surface and to further smooth out the rough edges. As herein shown there is still further provided under the rear section of the machine a pair of roughing devices 35 only one herein shown, and mounted similar to the roughened devices 16 and 16' whereby to roughen the lower corners of the block 7" in the exposed lower section 7" of the side wall of the block.

Figure 10:
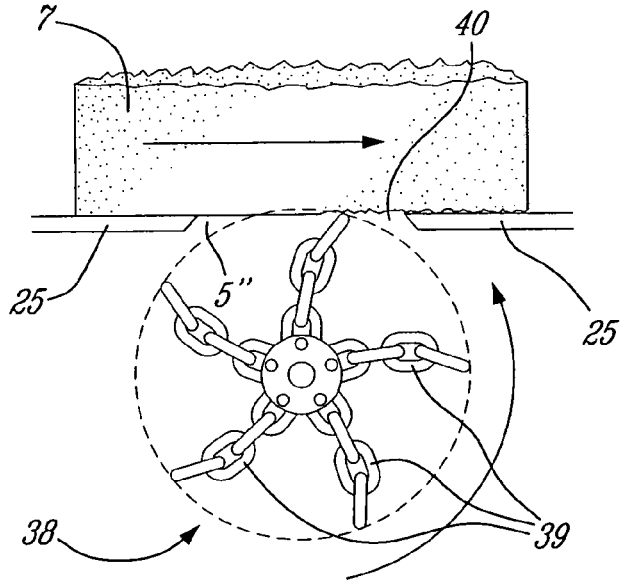
FIG. 10 is a simplified side view showing an optional modification of the machine whereby to abrade a bottom surface of casted concrete blocks conveyed through the surface roughing machine.

FIG. 10 shows an optional embodiment wherein the support metal rails 25 create an opening 40 therealong whereby to expose a section of the bottom surface 5" of the block 7 whereby to be abraded by the chains 39 of the bottom surface abrading device 38. This abrading device 38 would be located between the outlet end 41 of the surface roughing machine and the abrading machine 35. A discharge conveyor 42 is located at the outlet end 41 onto which roughened blocks are discharged.

Referring to FIG. 9 there is shown an end view of the surface roughing machine and as can be seen a debris collecting trough 50 is supported under the stationary support surface 3 whereby to collect debris such as dust and stone or concrete fragments 51 falling under the stationary support surface. A conveyor 53 conveys this debris into a collecting pit where the debris can be recycled.

Figure 7:
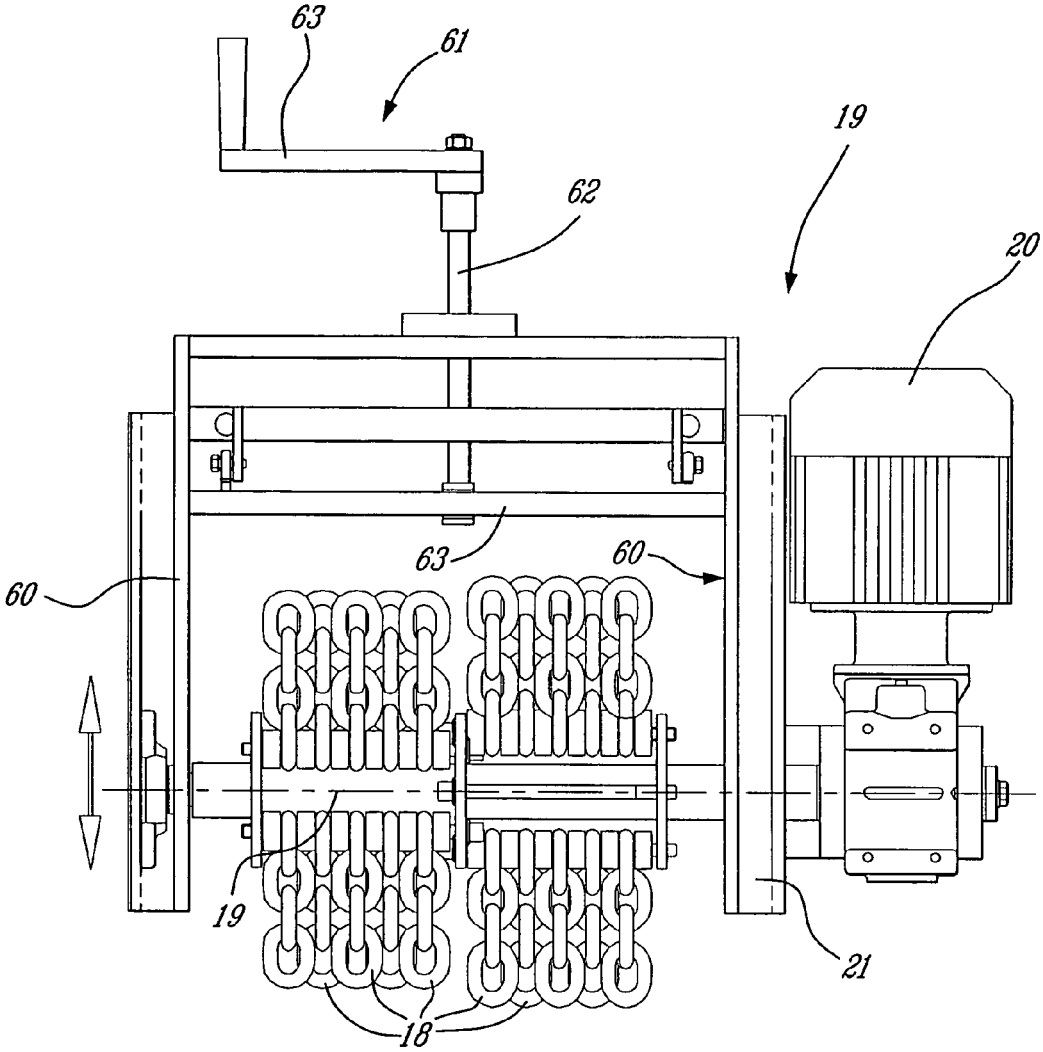
FIG. 7 is a side view illustrating the manner in which the abrading devices are adjustably displaced.
Figure 8:
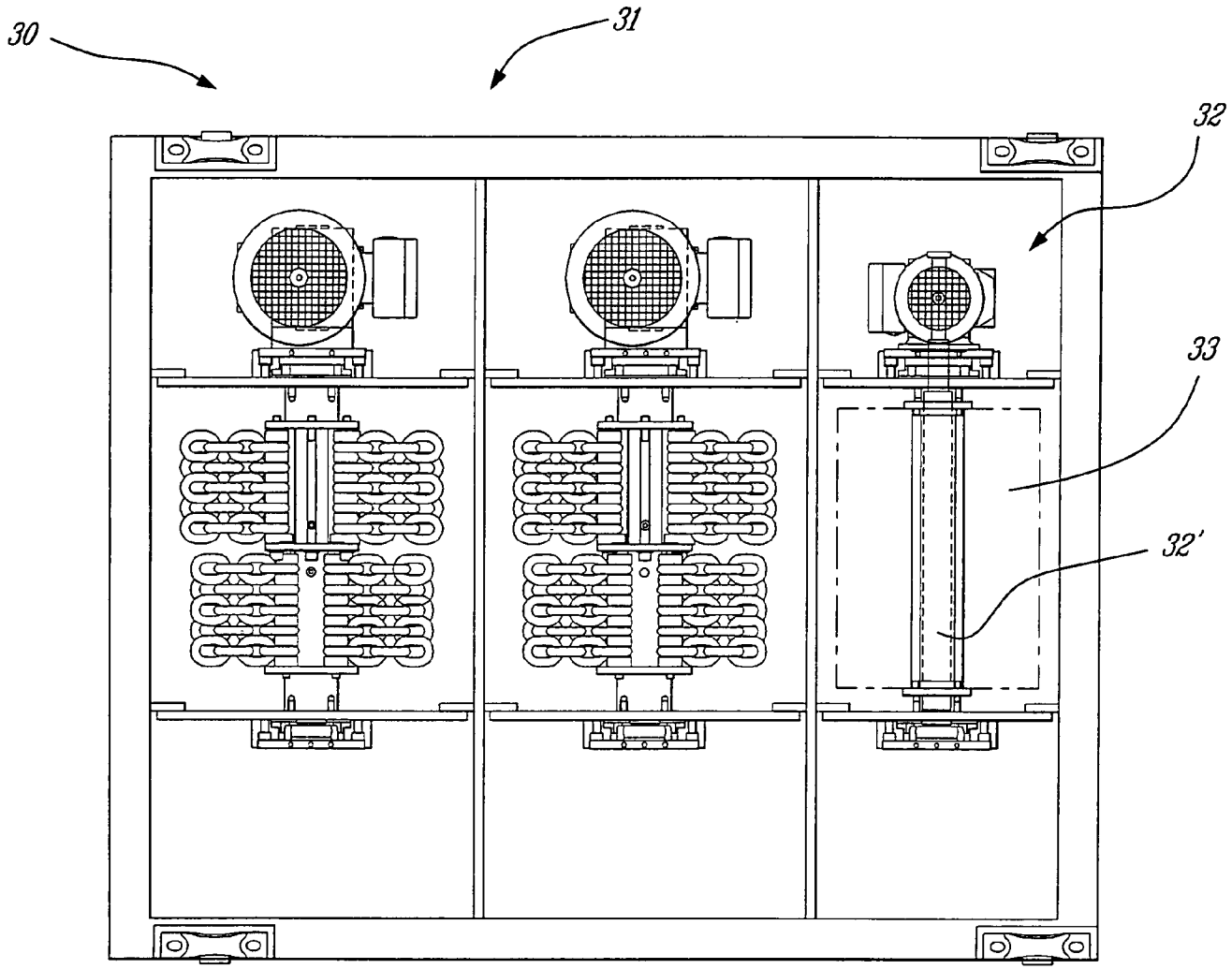
FIG. 8 is a top view showing the end section of the surface-roughing machine of FIG. 1.

FIG. 7 shows an adjustment mechanism for the abrading devices 16, 19, 30, 31 and 32 which are vertically adjusted just above the conveyor assembly. FIG. 7 shows the roughing device 19 and wherein its support frame 21 is vertically displaceable between a pair of guide brackets 60 by a crank assembly 61 which comprises a threaded rod 62 secured to a cross arm 63 and a crank lever 64. By rotating the crank lever the frame 21 is displaced up and down to adjust their position relative to the top surface of the block 7 conveyed thereunder.

Figure 4:
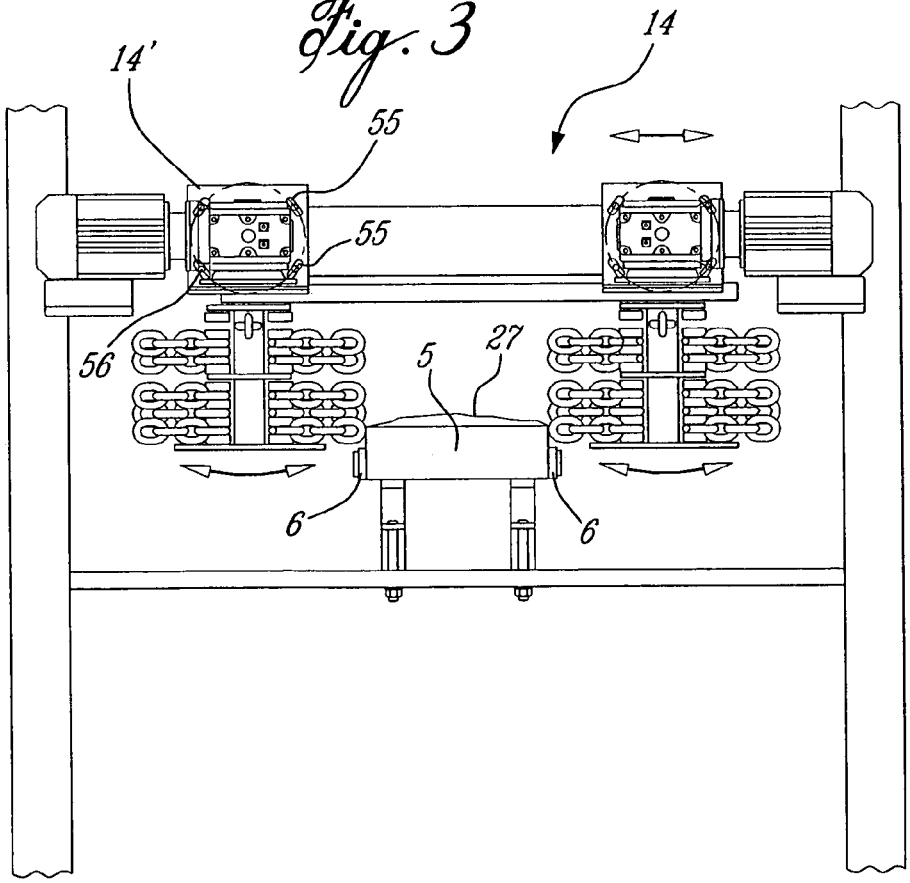
FIG. 4 is an end view showing the abrading device for abrading the top side surfaces of a concrete block.
Figure 5:
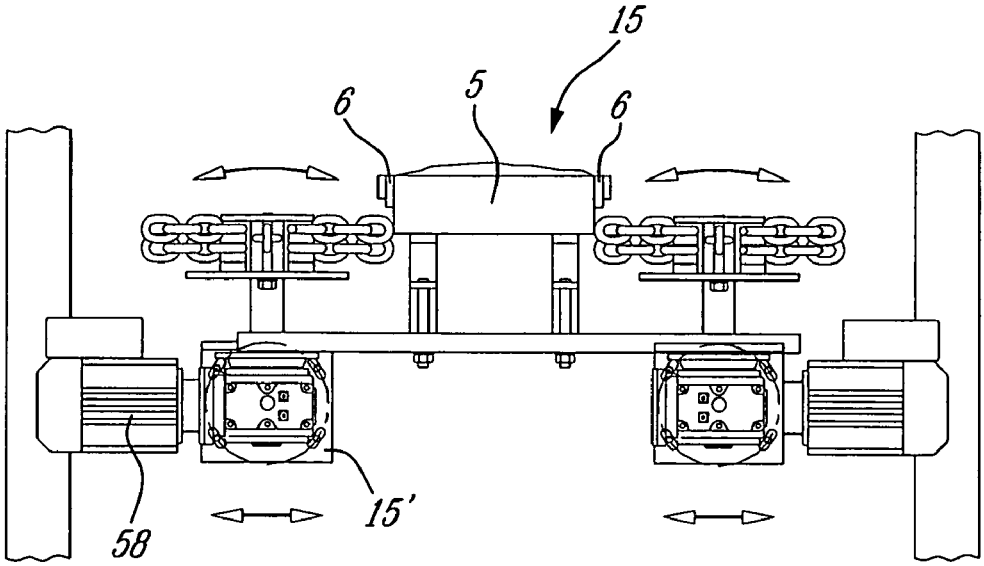
FIG. 5 is an end view illustrating the abrading devices for abrading a bottom side surface section of the casted concrete block.
Figure 6:
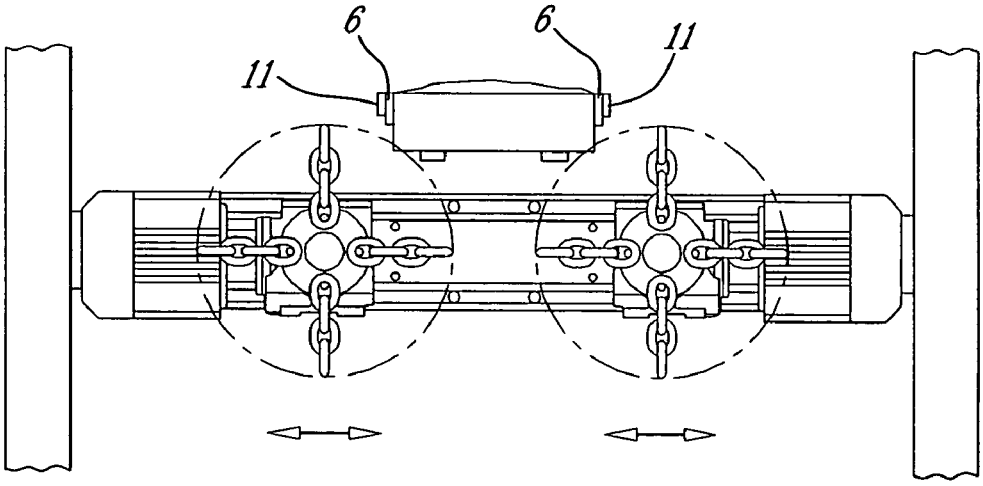
FIG. 6 is an end view showing the abrading devices for abrading lower corners of a casted concrete block conveyed thereby.

As shown in FIGS. 4 and 5 the side surface roughing devices 14 and 15 the mounting frames 14' and 15' are provided with angulated connecting slots 55 which receive connecting bolts 56 therein whereby to provide limited pivotal adjustment of the brackets 14' and 15' to permit the motors 57 and 58, and associated axles and chain links to be positioned at a tilt angle whereby to adjust the degree of fragmentation in the top side wall corners and bottom side wall corners of the concrete block 5. The usual tilt angle is between 0 to 10 degrees. It is also pointed out that the top frame 65 of the front section 13 can be pivoted by a hydralique cylinder 66. The top frame 67 of the rear section 28 can also be tilted by an associated hydralique cylinder 68.

The claims define the exclusive right granted for the present invention and such is not intended to be limited to the specific surface roughing machine as described herein but intended to cover obvious modifications thereof which are evident to a person skilled in the art.

The invention claimed is:

1. A casted concrete block surface roughing machine comprising a plurality of abrading devices an in-line conveyor displaceable over a stationary horizontal support surface for slidingly supporting a lower face of concrete blocks displaced thereon by said conveyor, said in-line conveyor having at least two pairs of spaced apart vertically supported narrow conveyor belts disposed to engage opposed side faces of said concrete blocks to displace them along said stationary horizontal support surface, said conveyor belts being pressure-biased against said opposed side faces, one of said pairs of conveyor belts engaging said opposed side faces in a lower surface section thereof to expose an upper surface section thereof to be abraded by respective first and second abrading devices, the other of said pairs of conveyor belts engaging said same opposed side faces in said upper surface section thereof to expose a lower surface section thereof to be abraded by further respective third and fourth abrading devices, a fifth abrading device along said in-line conveyor for abrading a top surface of said concrete blocks conveyed thereunder by said vertically supported conveyor belts, and sixth and seventh abrading devices for abrading a top side edge of opposed side faces of said concrete blocks conveyed thereby by said one of said pairs of conveyor belts.

2. A casted concrete block surface roughing machine as claimed in claim 1 wherein there is also provided along said in-line conveyor eight and ninth abrading devices for abrading a lower side edge of opposed side faces of said concrete blocks conveyed thereby by said other of said pairs of conveyor belts.

3. A casted concrete block surface roughing machine as claimed in claim 2 wherein there is further provided one or more top surface finishing abrading devices to smoothen a top rough surface of said concrete blocks, said concrete blocks fed to an inlet of said in-line conveyor having smooth contour flat surfaces.

4. A casted concrete block surface roughing machine as claimed in claim 3 wherein a last one of said one or more top surface abrading devices is a rotating brush.

5. A casted concrete block surface roughing machine as claimed in claim 1 wherein said abrading devices are comprised by a plurality of steel chains secured to a motor driven axle assembly secured to a support frame and oriented to impact onto specific areas of said concrete blocks.

6. A casted concrete block surface roughing machine as claimed in claim 5 wherein said support frame is an adjustable support frame, and means to displace said support frame to position said abrading device secured thereto at a desired position relative to said concrete blocks conveyed along said in-line conveyor.

7. A casted concrete block surface roughing machine as claimed in claim 6 wherein said motor driven axle is connected to an electric motor secured to said support frame by a pivot adjustment bracket to permit said motor and associated axle to be positioned at a tilt angle.

8. A casted concrete block surface roughing machine as claimed in claim 1 wherein said conveyor belts of said two pairs of conveyor belts are each trained between a pair of pulleys, at least one said pulleys being adjustable, displaceable to adjust the tension of its associated conveyor belt, a straight backing wall disposed behind a straight run of said conveyor belt which is in contact with concrete blocks conveyed thereby, said straight backing wall being adjustably displaceable in parallel relationship to an opposed wall of the other conveyor belt to receive blocks of different widths between said pairs of conveyor belts.

9. A casted concrete block surface roughing machine as claimed in claim 8 wherein said straight backing wall being pressure biased against its associated belt straight run to apply pressure of straight run against said concrete blocks side faces.

10. A casted concrete block surface roughing machine as claimed in claim 1 wherein there is further provided a debris collecting trough and conveyor for receiving and discharging stone dust and particles from under said in-line conveyor.

11. A casted concrete block surface roughing machine as claimed in claim 3 wherein there is still further provided a tenth abrading device supported under said stationary horizontal support surface in an opening thereof whereby to expose a section of a bottom surface of said concrete block as it is conveyed over said opening to be abraded by said tenth abrading device.

12. A casted concrete block surface roughing machine as claimed in claim 1 wherein said stationary horizontal support surface is constituted by one or more straight flat steel bars disposed along a straight conveyor path.

* * * * *